US006640758B2

(12) United States Patent
Ashida

(10) Patent No.: US 6,640,758 B2
(45) Date of Patent: Nov. 4, 2003

(54) ENGINE VALVE TIMING CONTROLLER

(75) Inventor: Masaaki Ashida, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/146,889

(22) Filed: May 17, 2002

(65) Prior Publication Data

US 2002/0174841 A1 Nov. 28, 2002

(30) Foreign Application Priority Data

May 22, 2001 (JP) ..... 2001-152311

(51) Int. Cl.[7] ..... F01L 1/34

(52) U.S. Cl. ..... 123/90.15; 123/90.17; 123/90.27; 123/90.31

(58) Field of Search ..... 123/90.15, 90.17, 123/90.27, 90.31

(56) References Cited

U.S. PATENT DOCUMENTS

| | | | | |
|---|---|---|---|---|
| 4,962,732 A | * | 10/1990 | Inoue et al. | 123/90.16 |
| 5,628,286 A | * | 5/1997 | Kato et al. | 123/90.15 |
| 6,330,505 B1 | * | 12/2001 | Schmitt et al. | 701/82 |
| 6,330,869 B1 | * | 12/2001 | Yoshiki et al. | 123/90.15 |

FOREIGN PATENT DOCUMENTS

| | | |
|---|---|---|
| JP | 5231111 A | 9/1993 |
| JP | 7233744 A | 9/1995 |
| JP | 10176557 A | 6/1998 |

* cited by examiner

*Primary Examiner*—Thomas Denion
*Assistant Examiner*—Ching Chang
(74) *Attorney, Agent, or Firm*—Shinjyu Global IP Counselors, LLP.

(57) ABSTRACT

An engine valve timing controller controls a hydraulically driven variable valve timing mechanism, based on coolant temperature and intake air temperature. If coolant temperature and intake air temperature at engine startup are at least equal to an operation assurance oil temperature and an absolute value of the difference between the two temperatures is less than or equal to a prescribed temperature, then oil temperature is determined to be at least as high as the operation assurance oil temperature. Thus, the valve timing mechanism operates after coolant temperature rises to a first operation permission coolant temperature that is a temperature at which increasing the amount of internal EGR by increasing the amount of valve overlap is permitted. If these conditions are not satisfied, then valve timing mechanism operates after coolant temperature rises to a second operation permission coolant temperature that is a temperature at which oil temperature is definitely at least equal to the operation assurance oil temperature.

10 Claims, 7 Drawing Sheets

ENGINE VALVE TIMING CONTROLLER

BACKGROUND OF THE INVENTION

1. Field of the Invention

The present invention generally relates to an engine valve timing controller that controls a hydraulically driven variable valve timing mechanism. More particularly, the present invention relates to a technology for determining when operation of a hydraulically driven variable timing mechanism is permitted.

2. Background Information

Hydraulically driven valve timing mechanisms have been known for some time that allow for adjustment of the opening and closing timing (valve timing) of intake and exhaust valves. In such hydraulically driven valve timing mechanisms, the control response of the valve timing declines when the engine is cool and the viscosity of the oil is high. If the response delay causes the amount of valve overlap to become excessive, then misfiring can result.

In view of this issue, the valve timing controller presented in Japanese Laid-Open Patent Publication No. 10-176557 estimates the oil temperature, which has a high correlation to the responsiveness of the variable valve timing mechanism, based on the engine coolant temperature and reduces the overlap amount when the coolant temperature is low.

Meanwhile, the device presented in Japanese Laid-Open Patent Publication No. 7-233744 estimates the operation delay time of the hydraulically driven variable valve timing mechanism based on the coolant temperature and the intake air temperature. Based on the operation delay time, the device controls the ignition timing so as to absorb the torque step that accompanies switching of the valve timing.

In view of the above prior art, there exists a need for an improved engine valve timing controller. This invention addresses this need in the art as well as other needs, which will become apparent to those skilled in the art from this disclosure.

SUMMARY OF THE INVENTION

It has been discovered that the amount of change in the oil temperature with respect to the rise in the coolant temperature is not necessarily regular. Rather, it has been discovered that the amount of change in the oil temperature with respect to the rise in the coolant temperature varies greatly depending on the operating conditions.

When the amount of overlap is limited based on the coolant temperature in the manner previously described, the amount of overlap is limited up to a relatively high temperature region in order to reliably avoid misfiring in cases where the aforementioned variation occurs. Consequently, the region over which the amount of overlap can be expanded is narrowed.

Another problem is that the effect on driveability resulting from poor combustion (increased amount of residual gas in combustion chamber) accompanying the decline in responsiveness of the variable valve timing mechanism when the oil temperature is low cannot be sufficiently remedied by controlling the ignition timing alone.

The present invention was created in view of these problems. One object of the present invention is to provide an engine valve timing controller that can achieve a precise estimate of the oil temperature (which correlates with the responsiveness of the hydraulically driven variable valve timing mechanism). Therefore, the engine valve timing controller of the present invention can reliably avoid degradation of the driveability caused by a decline in responsiveness while also maintaining the largest possible region in which the amount of overlap can be expanded.

In accordance with one aspect of the present invention, an engine valve timing controller is provided for controlling a hydraulically driven variable valve timing mechanism. The engine valve timing controller basically comprises a coolant temperature, an intake air temperature detecting device and a control unit. The coolant temperature detecting device is arranged and configured to detect engine coolant temperature. The intake air temperature detecting device is arranged and configured to detect engine intake air temperature. The control unit is operatively coupled to the coolant temperature detecting device and operatively coupled to the intake air temperature detecting device to receive signals that are representative of the engine coolant temperature and the engine intake air temperature. The control unit is configured to control the variable valve timing mechanism by determining if both the engine coolant temperature and the engine air intake temperature at time of engine startup are greater than or equal to an operation assurance oil temperature of the variable valve timing mechanism, and then preventing operation of the variable valve timing mechanism until the engine coolant temperature at least reaches a first operation permission coolant temperature that is higher than the operation assurance oil temperature. The control unit is also configured to control the variable valve timing mechanism by determining if at least one of the engine coolant temperature and the engine intake temperature at time of engine startup is less than the operation assurance oil temperature, and then preventing operation of the variable valve timing mechanism until the engine coolant temperature at least reaches a second operation permission coolant temperature that is higher than the first operation permission coolant temperature.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following description of the embodiments of the present invention is provided for illustration only, and not for the purpose of limiting the invention as defined by the appended claims and their equivalents.

Figure 1:
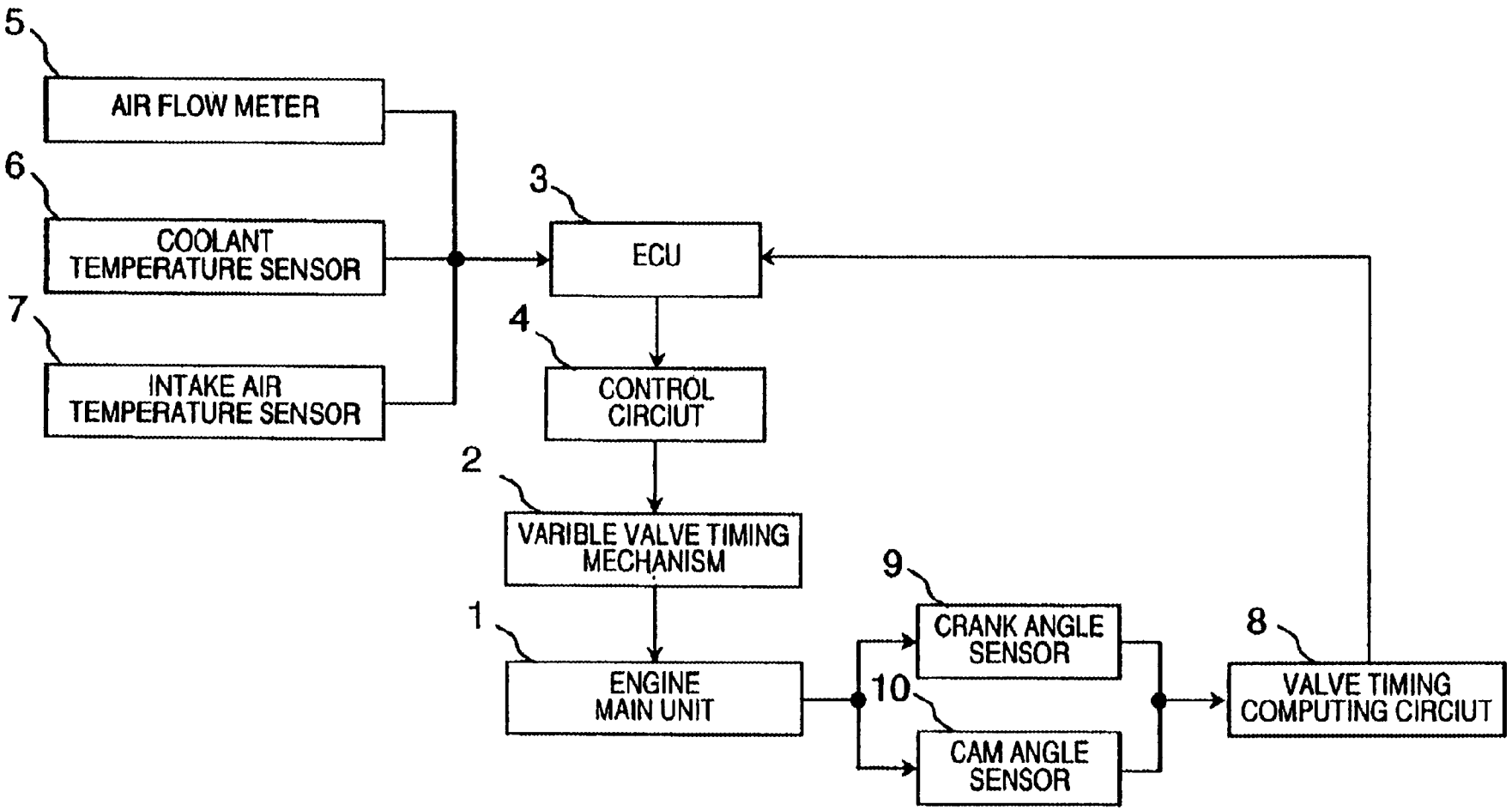
FIG. 1 is a block diagram of an engine valve timing controller in accordance with one embodiment of the present invention.

Referring initially to FIG. 1, a block diagram of an engine valve timing controller that embodies the present invention is illustrated in accordance with one embodiment of the present invention. An engine main unit 1 is mounted in a vehicle and equipped with a hydraulically driven variable valve timing mechanism (VTC) 2. The hydraulically driven variable valve timing mechanism 2 is driven through a control circuit 4 based on a control signal outputted from an engine control unit (ECU) 3. The engine control unit 3 receives detection signals from the following devices: an airflow meter 5, a coolant temperature sensor 6 and an intake air temperature sensor 7. The airflow meter 5 is configured and arranged to detect the intake airflow rate of the engine. The coolant temperature sensor 6 functions as a coolant temperature detecting device that detects the temperature TW of the engine coolant. The intake air temperature sensor 7 functions as an intake air temperature detecting device that detects the temperature TINT of the engine intake air. The engine control unit 3 also receives valve timing computation results from a valve timing computing circuit 8. The valve timing computing circuit 8 computes the rotational phase of the camshaft with respect to the crankshaft (i.e., computes the valve timing) based on the detection signals from the crank angle sensor 9 and the cam angle sensor 10.

As explained below, the engine valve timing controller of present invention allows the oil temperature conditions that can ensure good response to be determined precisely without detecting the oil temperature directly. The engine valve timing controller of present invention can avoid operating the hydraulically driven variable valve timing mechanism 2 under conditions where the response will be slow while enabling the hydraulically driven variable valve timing mechanism 2 to be operated as quickly as possible.

Figure 7:
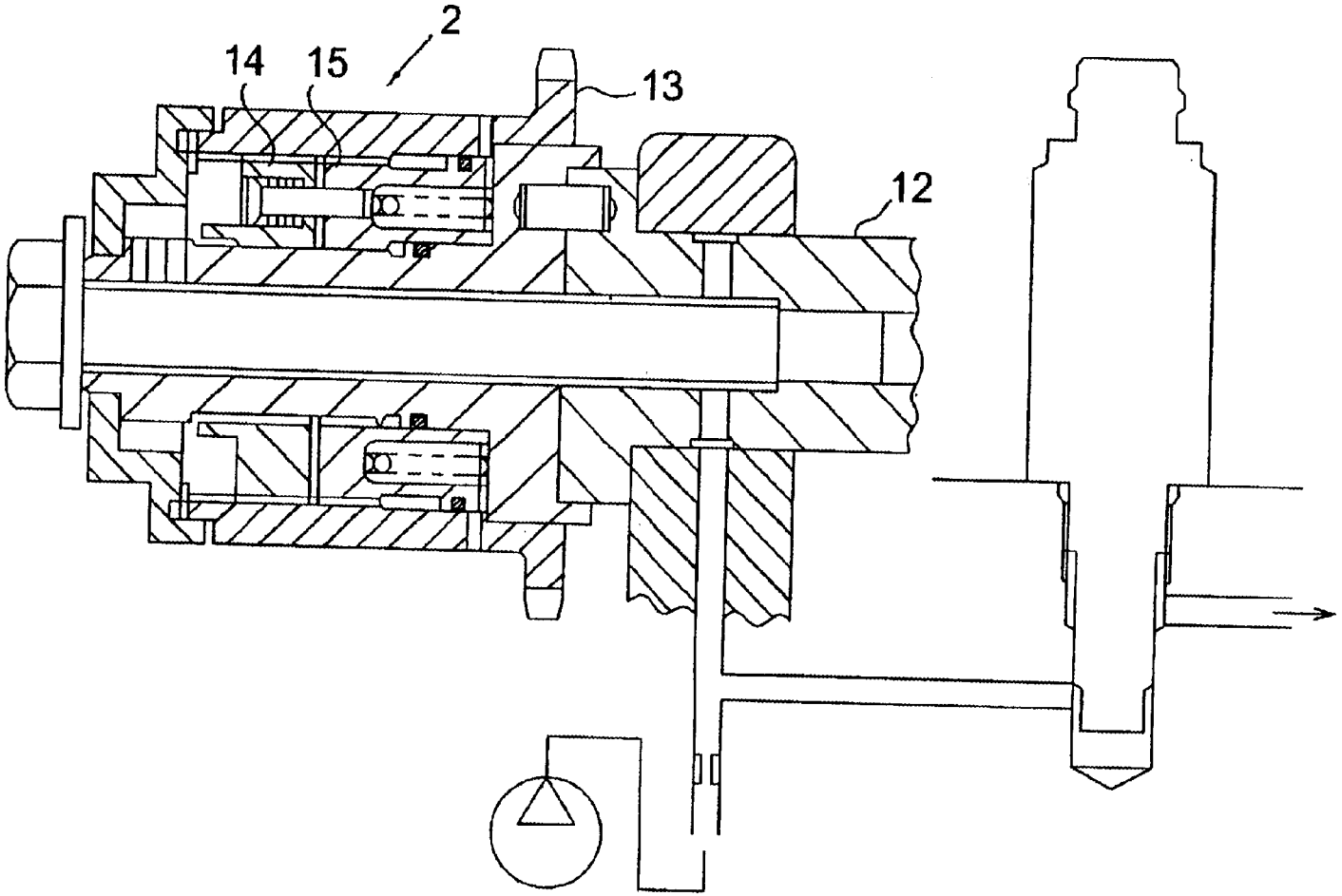
FIG. 7 is a partial cross sectional view of the hydraulically driven variable valve timing mechanism (VTC) used in accordance with one embodiment of the present invention.

The hydraulically driven variable valve timing mechanism 2 is a conventional component that is well known in the art. The hydraulically driven variable valve timing mechanism 2 changes the amount of valve overlap by changing the valve timing (open/close timing) of the intake valves and/or exhaust valves. When this variable valve timing mechanism 2 is not operating, the valve overlap is set to the minimum amount, and when it operates, the valve overlap is changed to a larger amount. As seen in FIG. 7, the hydraulically driven variable valve timing mechanism 2 changes the rotational phase of a camshaft 12 with respect to the crankshaft (not shown). This variable valve timing mechanism 2 operatively couples the cam sprocket 13 and the camshaft 12 together via a pair of helical gears 14 and 15 that moves in response to hydraulic pressure. By controlling the hydraulic pressure that acts on the helical gears 14 and 15, the variable valve timing mechanism 2 moves the helical gears 14 and 15 along the rotational axis and causes the cam sprocket and camshaft to rotate relative to each other. This particular variable valve timing mechanism 2 is discussed in greater detail in Japanese Laid-Open Patent Publication No. 5-231111. Since hydraulically driven variable valve timing mechanisms are well known in the art, the hydraulically driven variable valve timing mechanism 2 will not be discussed or illustrated in further detail herein. Moreover, the hydraulically driven variable valve timing mechanism 2 is not limited to a mechanism that changes the rotational phase of the camshaft with respect to the crankshaft using helical gears as in the illustrated embodiment.

Figure 2:
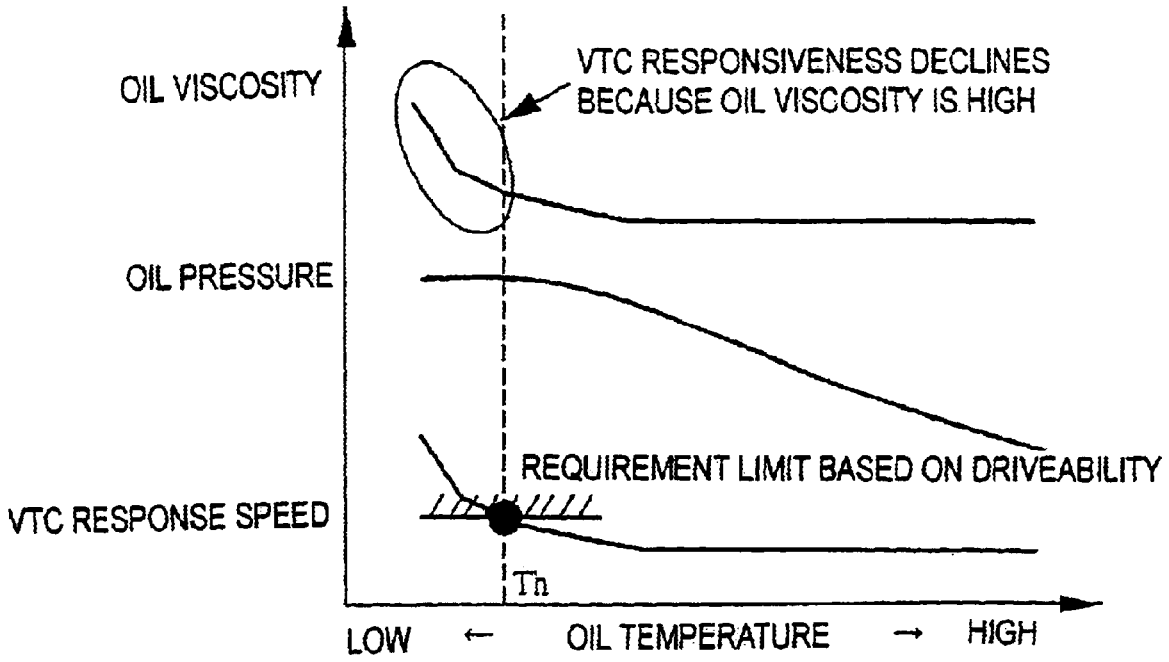
FIG. 2 is a graph showing the correlation between the oil temperature and the response speed of the variable valve timing mechanism in accordance with the illustrated embodiment of the present invention.

As shown in FIG. 2, the response speed of the hydraulically driven variable valve timing mechanism 2 declines when the oil temperature decreases and the oil viscosity increases. Therefore, it is necessary to prohibit the operation of the hydraulically driven variable valve timing mechanism 2 under response conditions (oil temperatures) that are below the requirement limit needed to obtain the required response speed.

Figure 3:
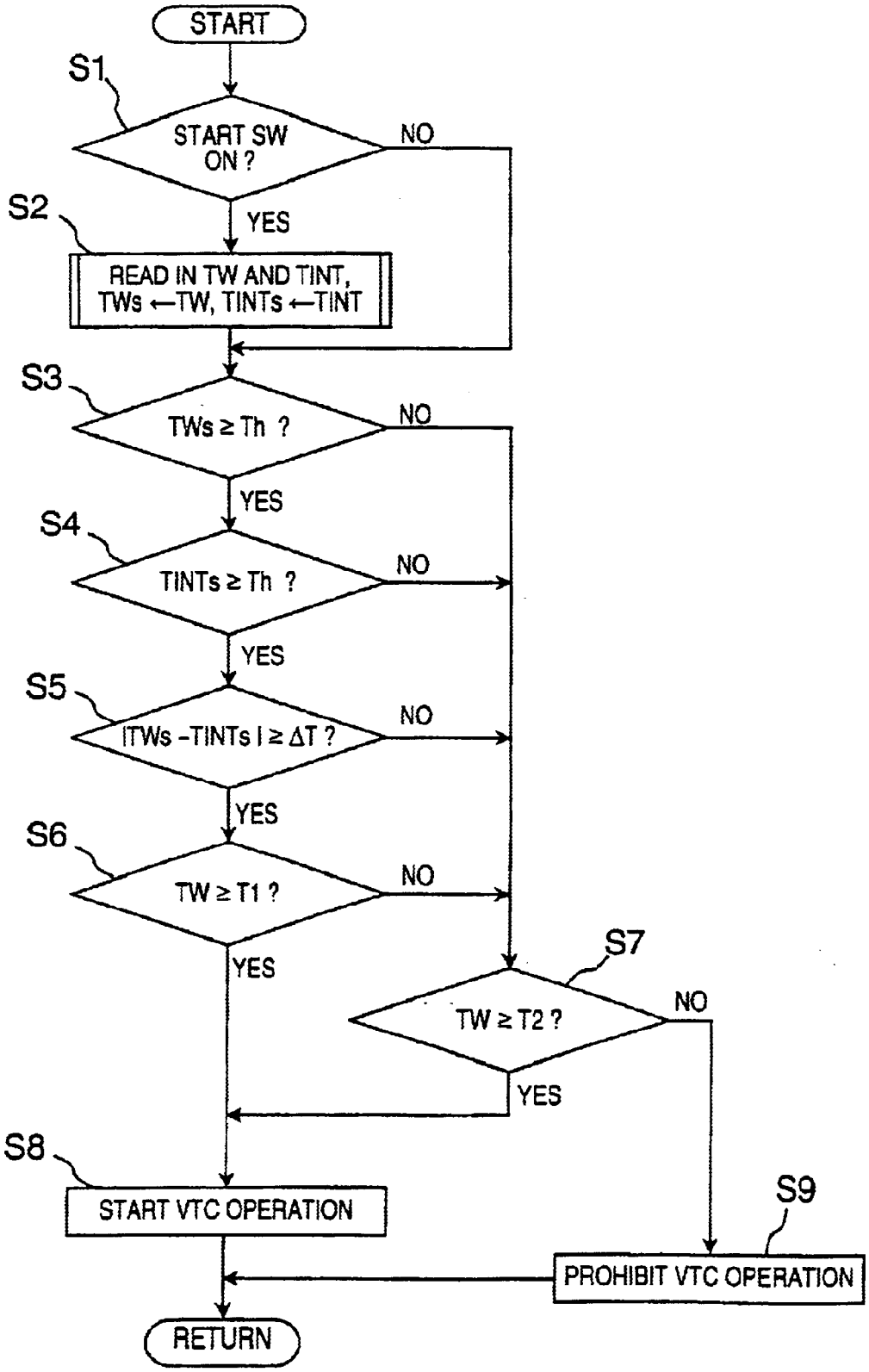
FIG. 3 is a flowchart showing the flow of the determination to permit or prohibit operation of the variable valve timing mechanism in accordance with the illustrated embodiment of the present invention.

However, the invention of this embodiment is not provided with an oil temperature sensor that directly detects the oil temperature of the variable valve timing mechanism 2. Since the oil temperature correlates to the responsiveness of the variable valve timing mechanism 2, the engine control unit 3 of this embodiment estimates the oil temperature based on the coolant temperature TW and the intake air temperature TINT as shown in the flowchart of FIG. 3. Thus, the engine control unit 3 determines whether or not to permit operation of the variable valve timing mechanism 2 without directly detects the oil temperature of the variable valve timing mechanism 2.

The engine control unit 3 preferably includes a microcomputer with an engine control program that controls the variable valve timing mechanism 2 as discussed below. The engine control unit 3 can also include other conventional components such as an input interface circuit, an output interface circuit, and storage devices such as a ROM (Read Only Memory) device and a RAM (Random Access Memory) device. The memory circuit stores processing results and control programs that are run by the processor circuit. The engine control unit 3 is operatively coupled to the variable valve timing mechanism 2 in a conventional manner. The internal RAM of the engine control unit 3 stores statuses of operational flags and various control data. The internal ROM of the engine control unit 3 stores various predetermined data for various operations. The engine control unit 3 is capable of selectively controlling any of the components of the control system in accordance with the control program. It will be apparent to those skilled in the art from this disclosure that the precise structure and algorithms for the engine control unit 3 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause. In this embodiment, the engine control unit 3 is provided with software that performs the functions of a permission temperature setting device and an operation permitting device, as shown in the flowchart of FIG. 3.

Turning now to FIG. 3, a flowchart is illustrated that shows the flow of the determination of the engine control unit 3 to permit or prohibit operation of the variable valve timing mechanism 2 in accordance with the illustrated embodiment of the present invention.

In Step S1 of the flowchart shown in FIG. 3, the engine control unit 3 determines if the start switch was just turned ON. If it is determined that the start switched was just turned ON, then the engine control unit 3 proceeds to Step S2.

In Step S2, the engine control unit 3 reads the coolant temperature TW currently detected by the coolant temperature sensor 6 and the intake air temperature TINT currently detected by the intake air sensor 7 at the point in time when the start switch was turned ON. The engine control unit 3 stores the readings from the coolant temperature sensor 6 and the intake air sensor 7 as the engine startup temperature data TWs and TINTs, respectively.

In Step S3, the engine control unit 3 determines if the engine startup coolant temperature TWs is greater than or equal to an operation assurance oil temperature Th of the variable valve timing mechanism 2. The operation assurance oil temperature Th corresponds to the minimum oil temperature for which the required response speed can be obtained, and thus, indicates the response speed requirement limit.

If the engine startup coolant temperature TWs is determined to be greater than or equal to the operation assurance oil temperature Th in Step S3, then the engine control unit 3 proceeds to Step S4. In Step S4, the engine control unit 3 determines if the engine startup intake air temperature TINTs is greater than or equal to the operation assurance oil temperature Th.

If the engine startup intake air temperature TINTs is determined to be greater than or equal to the operation assurance oil temperature Th in Step S4, then the engine control unit 3 proceeds to Step S5. In Step S5, the engine control unit 3 determines if the absolute value of the difference between the engine startup coolant temperature TWs and the engine startup intake air temperature TINTs is greater than or equal to a prescribed temperature ΔT (i.e., if $|TWs-TINTs| \leqq \Delta T$). It is preferred to set the prescribed temperature ΔT to a value corresponding approximately to the variation (approximately 5 C°) in the coolant temperatures detected by the coolant temperature sensor 6 plus 3 C°.

Thus, when both the coolant temperature TWs and air intake temperature TINTs at the time at the time of engine startup are greater than or equal to the operation assurance oil temperature Th, the engine control unit 3 determines whether or not the difference between the coolant temperature TWs and the air intake temperature TINTs at the time of engine startup exceeds the prescribed temperature ΔT.

In other words, if the absolute value of the difference between the engine startup coolant temperature TWs and the engine startup intake air temperature TINTs is greater than or equal to a prescribed temperature ΔT (i.e., if $|TWs-TINTs| \leqq \Delta T$), then the engine control unit 3 proceeds to Step S6. In Step S6, the engine control unit 3 determines if the latest detected coolant temperature TW is greater than or equal to a first operation permission coolant temperature TW1.

When the post-engine-start coolant temperature TW reaches or exceeds the first operation permission coolant temperature TW1, then the engine control unit 3 proceeds to Step S8 where it permits operation of the variable valve timing mechanism 2. However, until the coolant temperature TW reaches or exceeds the first operation permission coolant temperature TW1, then the engine control unit 3 proceeds to Step S9 where it prohibits operation of the variable valve timing mechanism 2. The first operation permission coolant temperature TW1 is set to a temperature that is greater than the operation assurance oil temperature Th.

Thus, with this invention, if the coolant temperature TWs and the intake air temperature TINTs at the time of engine startup are both greater than or equal to the operation assurance oil temperature Th, the engine control unit 3 estimates that the oil temperature is also greater than or equal to the operation assurance oil temperature Thus, the engine control unit 3 estimates that there is no degradation of driveability caused by a delay in the response of the variable valve timing mechanism 2. Therefore, the engine control unit 3 permits operation (expansion of overlap amount) when the coolant temperature TW has risen to the first operation permission coolant temperature TW1, which is the coolant temperature condition at which changing the valve timing is permitted.

If this difference between the engine startup coolant temperature TWs and the engine startup intake air temperature TINTs is less than or equal to the prescribed temperature ΔT, i.e., if the coolant temperature and intake air temperature at the time of engine startup are close, then the engine control unit 3 permits operation of the variable valve timing mechanism 2 when the coolant temperature TW reaches or exceeds the first operation permission coolant temperature TW1.

Meanwhile, the engine control unit 3 proceeds to Step S7, if the determination is NO at any of Steps S3 to S5, i.e., if any one of the following three conditions is satisfied: (1) the engine start coolant temperature TWs is lower than the operation assurance oil temperature Th; (2) the engine start intake air temperature TINTs is lower than the operation assurance oil temperature Th; or (3) $|TWs-TINTs| > \Delta T$. In other words, if the coolant temperature TWs and/or the intake air temperature TINTs at the time of engine startup is lower than the operation assurance oil temperature Th, then the engine control unit 3 estimates that the oil temperature may be lower than the operation assurance oil temperature Th. Therefore, the engine control unit 3 waits until the coolant temperature TW reaches a second operation permission coolant temperature TW2 before permitting operation of the variable valve timing mechanism 2. The second operation permission coolant temperature TW2 is higher than the first operation permission coolant temperature TW1 and is high enough for the engine control unit 3 to estimate that the oil temperature is definitely above the operation assurance oil temperature Th.

Thus, in Step S7, the engine control unit 3 determines if the latest detected coolant temperature TW is greater than or equal to the second operation permission coolant temperature TW2. The second operation permission coolant temperature TW2 is greater than the first operation permission coolant temperature TW1, which is greater than operation assurance oil temperature Th.

When the post-engine-start coolant temperature TW reaches or exceeds the second operation permission coolant temperature TW2, then the engine control unit 3 proceeds to step 8 where it permits operation of the variable valve timing mechanism 2. However, until the coolant temperature TW reaches or exceeds the second operation permission coolant temperature TW2, the engine control unit 3 proceeds to Step S9 where it prohibits operation of the variable valve timing mechanism 2.

Thus, the present invention can avoid even more reliably operation of the variable valve timing mechanism 2 under conditions where the response will be slow. It accomplishes this by using a higher coolant temperature as the condition for permitting operation of the variable valve timing mechanism 2 even when both the coolant temperature TWs and the air intake temperature TINTs at the time of engine startup are higher than the operation assurance oil temperature Th, e.g., when the engine is restarted immediately after stopping.

Next, the determination (shown in the flowchart of FIG. 3) of whether to permit or prohibit operation of the variable valve timing mechanism 2 will be explained in more detail. If the absolute value of the difference between the engine startup coolant temperature TWs and the engine startup intake air temperature TINTs is less than or equal to the prescribed temperature ΔT (i.e., if $|TWs-TINTs| \leqq \Delta T$), then the engine control unit 3 estimates that the coolant temperature TW is in equilibrium with respect to intake air temperature TINT. In this state, if the engine startup coolant temperature TWs and the engine startup air intake temperature TINTs are both greater than or equal to the operation assurance oil temperature Th, then the engine control unit 3 estimates that the temperature of the oil in the variable valve timing mechanism 2 is also greater than or equal to operation assurance oil temperature Th (see point A in FIG. 4).

In such a case, the hydraulic oil satisfies the oil temperature condition that can guarantee the responsiveness of the variable valve timing mechanism 2 and a decline in driveability caused by a response delay in the variable valve timing mechanism 2 can be avoided. However, if the amount of valve overlap is increased when the engine is cool, combusted gases will blow back and cause the amount of fuel adhered to the wall surface to increase cold hesitation to occur.

Therefore, although the engine control unit 3 controls the enlargement of the valve overlap so as to obtain a value suited to the driving conditions (e.g., load and engine speed), the engine control unit 3 waits until the coolant temperature TW rises to the first operation permission coolant temperature TW1 (which is the minimum temperature condition at which cold hesitation can be prevented) before permitting operation of the variable valve timing mechanism 2, i.e., permitting enlargement of the valve overlap. This prevents cold hesitation by reducing the amount of wall surface fuel adhesion when the temperature is low.

The oil temperature estimation in this embodiment is based on the assumption that the oil temperature is always greater than or equal to the intake air temperature. This assumption is based on actual vehicle evaluation results showing that the intake air temperature never exceeds the oil temperature, even during long periods of idling when the rise in intake air temperature is most marked.

Figure 5:
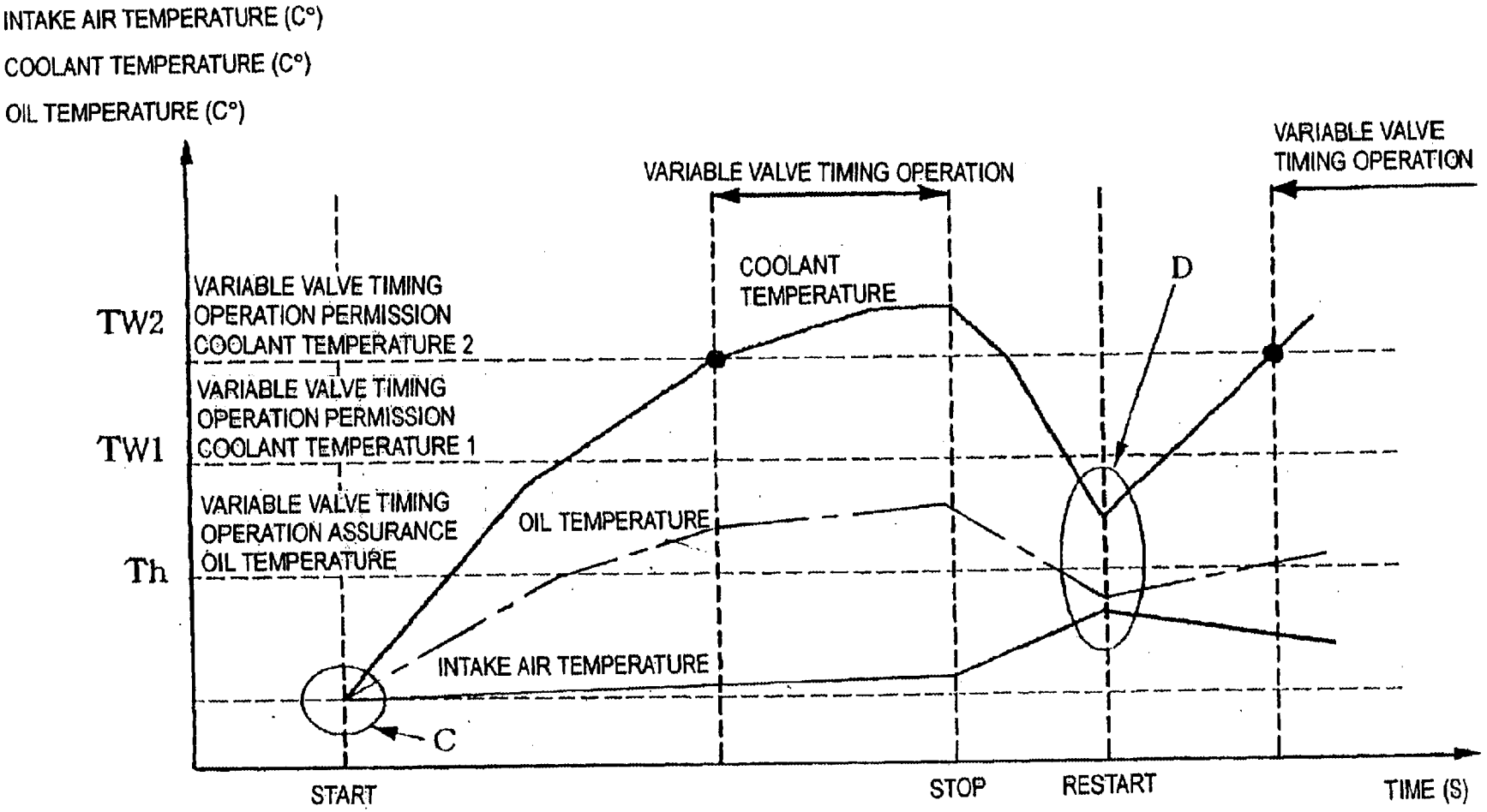
FIG. 5 is a time chart showing the correlation between the coolant temperature, the oil temperature, the intake air temperature, and the operation permission conditions of the variable valve timing mechanism in accordance with the illustrated embodiment of the present invention.

Meanwhile, if the engine startup coolant temperature TWs and/or the engine startup intake air temperature TINTs is lower than operation assurance oil temperature Th (see points C and D in FIG. 5), then the engine control unit 3 estimates that the oil temperature is below the operation assurance oil temperature Th. Thus, the engine control unit 3 waits until the coolant temperature reaches or exceeds the second operation permission coolant temperature TW2 before permitting operation of the variable valve timing mechanism 2, i.e., permitting enlargement of the valve overlap. In other words, the engine control unit 3 waits until the coolant temperature is definitely greater than or equal to the operation assurance oil temperature Th before permitting operation of the variable valve timing mechanism 2.

Figure 6:
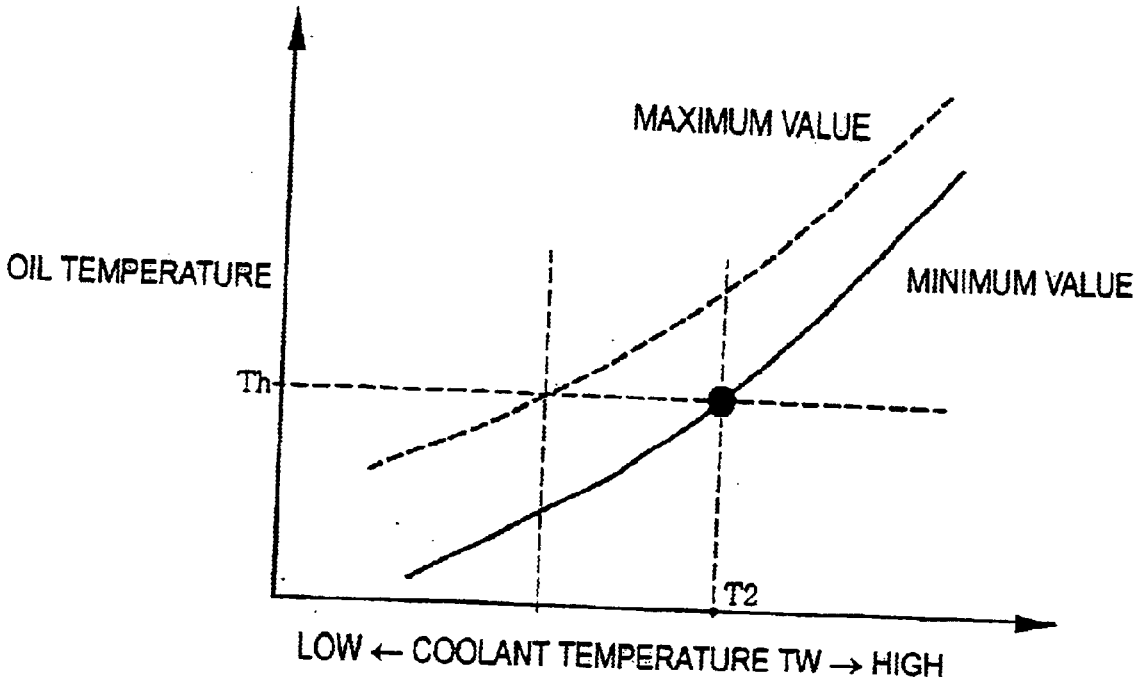
FIG. 6 is a graph showing the correlation between the oil temperature and the second operation permission coolant temperature TW2 in accordance with the illustrated embodiment of the present invention.

The second operation permission coolant temperature TW2 is established by finding variation in the correlation between the coolant temperature TW and the oil temperature of an actual vehicle experimentally. In other words, the second operation permission coolant temperature TW2 for a particular vehicle is based on this correlation between the coolant temperature TW and the oil temperature for that particular vehicle. Referring to FIG. 6, the second operation permission coolant temperature TW2 is preferably the coolant temperature TW that corresponds to the operation assurance oil temperature Th on the characteristic curve indicating the minimum oil temperature with respect to the coolant temperature TW (minimum value).

Therefore, if the coolant temperature TW is greater than or equal to the second operation permission coolant temperature TW2, the engine control unit 3 will estimate that the oil temperature is at least as high as operation assurance oil temperature Th. In addition to avoiding driveability degradation caused by a delayed response of the variable valve timing mechanism 2, cold hesitation is also prevented. This occurs because the second operation permission coolant temperature TW2 is greater than the first operation permission coolant temperature TW1 and the amount of wall surface fuel adhesion occurring when the temperature is low is reduced.

Figure 4:
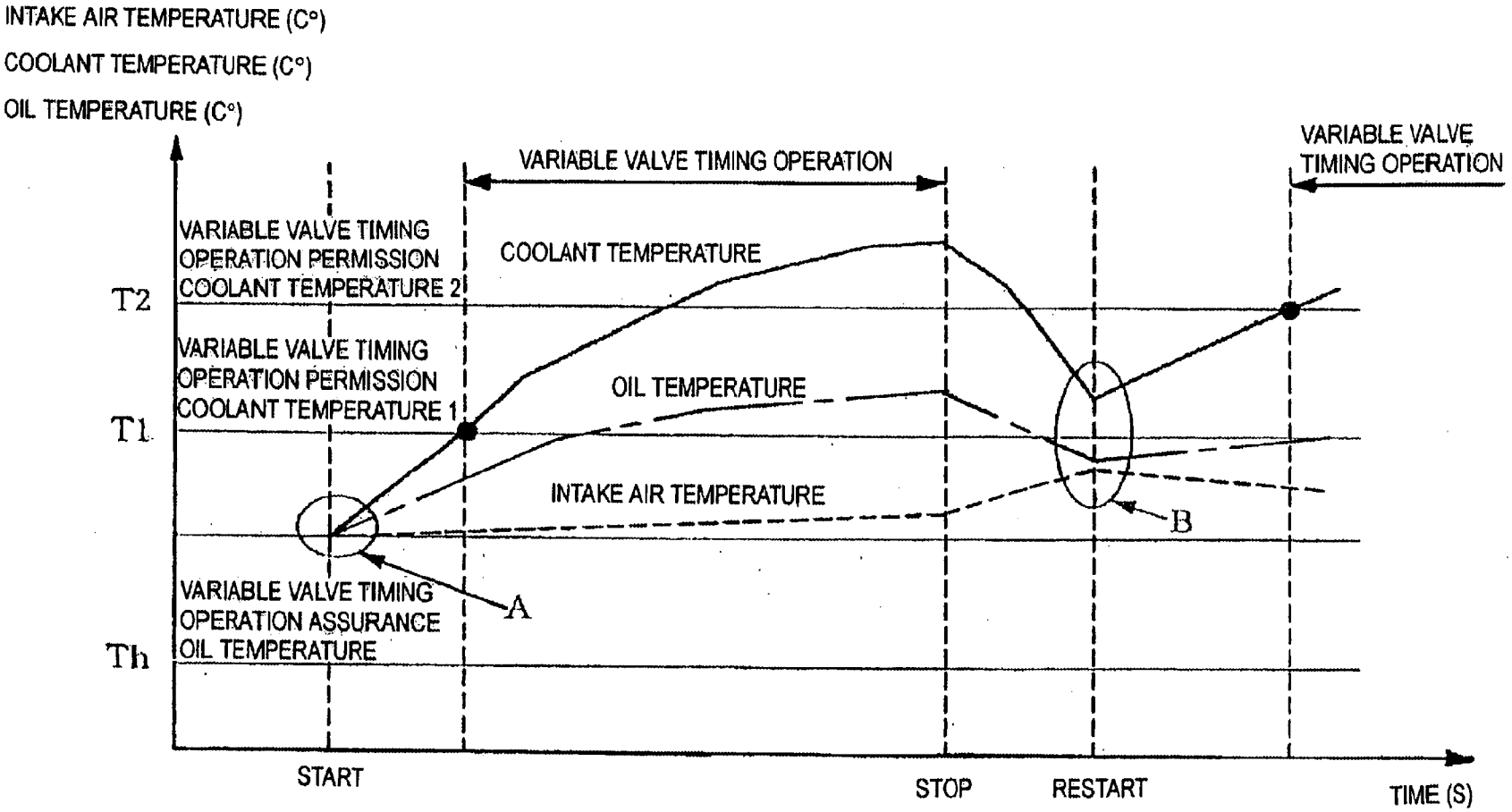
FIG. 4 is a time chart showing the correlation between the coolant temperature, the oil temperature, the intake air temperature, and the operation permission conditions of the variable valve timing mechanism in accordance with the illustrated embodiment of the present invention.

Even if the engine startup coolant temperature TWs and the engine startup intake air temperature TINTs are both greater than or equal to the operation assurance oil temperature Th, the engine control unit 3 will determine that the engine has been restarted immediately after being stopped if the absolute value of the difference between the engine startup coolant temperature TWs and the engine startup intake air temperature TINTs exceeds a prescribed temperature ΔT (i.e., if $|TWs-TINTs| > \Delta T$) (see point B of FIG. 4). In such a case, the precision will decline if the oil temperature condition is estimated based on the coolant temperature.

Therefore, the engine control unit 3 waits until the coolant temperature TW reaches or exceeds the second operation permission coolant temperature TW2 before permitting operation of the variable valve timing mechanism 2, i.e., permitting enlargement of the valve overlap. By using the second operation permission coolant temperature TW2, the engine control unit 3 reliably avoids driveability degradation caused by a delayed response of the variable valve timing mechanism 2 and cold hesitation is prevented because the amount of wall surface fuel adhesion occurring when the temperature is low is reduced.

The term "configured" as used herein to describe a component, section or part of a device includes hardware and/or software that is constructed and/or programmed to carry out the desired function. As used herein, the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2001-152311. The entire disclosure of Japanese Patent Application No. 2001-152311 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents. Thus, the scope of the invention is not limited to the disclosed embodiments.

What is claimed is:

1. An engine valve timing controller for controlling a hydraulically driven variable valve timing mechanism, comprising:

a coolant temperature detecting device arranged and configured to detect engine coolant temperature;

an intake air temperature detecting device arranged and configured to detect engine intake air temperature; and a control unit operatively coupled to said coolant temperature detecting device and operatively coupled to said intake air temperature detecting device to receive signals that are representative of the engine coolant temperature and the engine intake air temperature, said control unit being configured to control the variable valve timing mechanism by determining if both the engine coolant temperature and the engine air intake temperature at time of engine startup are greater than or equal to an operation assurance oil temperature of the variable valve timing mechanism, and then preventing operation of the variable valve timing mechanism until the engine coolant temperature at least reaches a first operation permission coolant temperature that is higher than the operation assurance oil temperature; and determining if at least one of the engine coolant temperature and the engine intake temperature at time of engine startup is less than the operation assurance oil temperature, and then preventing operation of the variable valve timing mechanism until the engine coolant temperature at least reaches a second operation permission coolant temperature that is higher than said first operation permission coolant temperature.

2. The engine valve timing controller as recited in claim 1, wherein said control unit is further configured to control the variable valve timing mechanism by determining if an absolute difference between the engine coolant temperature and the engine air intake temperature at time of engine startup exceeds a prescribed temperature value, and then preventing operation of the variable valve timing mechanism until the engine coolant temperature at least reaches said second operation permission coolant temperature, even if both the engine coolant temperature and the engine air intake temperature at time of engine startup are greater than or equal to the operation assurance oil temperature.

3. An engine valve timing controller for controlling a hydraulically driven variable valve timing mechanism, comprising:

a coolant temperature detecting device arranged and configured to detect engine coolant temperature;

an intake air temperature detecting device arranged and configured to detect engine intake air temperature; and a control unit operatively coupled to said coolant temperature detecting device and operatively coupled to said intake air temperature detecting device to receive signals that are representative of the engine coolant temperature and the engine intake air temperature, said control unit being configured to control the variable valve timing mechanism by determining if the difference between the engine coolant temperature and the engine air intake temperature at time of engine startup is less than or equal to a prescribed temperature value, and then preventing operation of the variable valve timing mechanism until the engine coolant temperature at least reaches a first operation permission coolant temperature that is higher than the operation assurance oil temperature of the variable valve timing mechanism; and determining if an absolute difference between the engine coolant temperature and the engine air intake temperature at time of engine startup exceeds said prescribed temperature value, and then preventing operation of the variable valve timing mechanism until the engine coolant temperature at least reaches a second operation permission coolant temperature that is higher than said first operation permission coolant temperature.

4. The engine valve timing controller as recited in claim 3, wherein said control unit is further configured to control the variable valve timing mechanism by determining if at least one of the engine coolant temperature and the engine air intake temperature at time of engine startup is less than the operation assurance oil temperature, and then preventing operation of the variable valve timing mechanism until the engine coolant temperature at least reaches said second operation permission coolant temperature, even if the difference between the engine coolant temperature and the engine air intake temperature at time of engine startup is less than or equal to a prescribed temperature value.

5. An engine valve timing controller for controlling a hydraulically driven variable valve timing mechanism, comprising:

a coolant temperature detecting device arranged and configured to detect engine coolant temperature;

an intake air temperature detecting device arranged and configured to detect engine intake air temperature; and a control unit operatively coupled to said coolant temperature detecting device and operatively coupled to said intake air temperature detecting device to receive signals that are representative of the engine coolant temperature and the engine intake air temperature, said control unit including a permission condition/temperature setting device arranged and configured to set a threshold value for the coolant temperature at which operation of the variable valve timing mechanism will be permitted based on a comparison of the engine coolant temperature and the engine intake air temperature at time of engine startup with the operation assurance oil temperature of the variable valve timing mechanism; and an operation permitting device arranged and configured to permit operation of the variable valve timing mechanism when the coolant temperature reaches or exceeds the threshold value set by said permission condition/temperature setting device.

6. The engine valve timing controller as recited in claim 5, wherein said permission condition/temperature setting device sets said threshold value to a first operation permission coolant temperature that is higher than the operation assurance oil temperature, if both the engine coolant temperature and the engine air intake temperature at time of engine startup are greater than or equal to the operation assurance oil temperature, and said permission condition/temperature setting device sets said threshold value to a second operation permission coolant temperature that is higher than said first operation permission coolant temperature, if at least one of the engine coolant temperature and the engine air intake temperature at the time of engine startup is less than the operation assurance oil temperature.

7. The engine valve timing controller as recited in claim 5, wherein said permission condition/temperature setting device sets said threshold value based on a comparison of the engine coolant temperature and the engine air intake temperature at time of engine startup with the operation assurance oil temperature of the variable valve timing mechanism, and a comparison of the difference between the engine coolant temperature and the engine air intake temperature at time of engine startup with a prescribed temperature value.

8. The engine valve timing controller as recited in claim 7, wherein said permission condition/temperature setting device sets said threshold value to a first operation permission coolant temperature that is higher than the operation assurance oil temperature, if both the engine coolant temperature and the engine air intake temperature at time of engine startup are greater than or equal to the operation assurance oil temperature and said difference is less than or equal to said prescribed temperature value, and said permission condition/temperature setting device sets said threshold value to a second operation permission coolant temperature that is higher than said first operation permission coolant temperature, if at least one of the engine coolant temperature and the engine air intake temperature at the time of engine startup is less than the operation assurance oil temperature or if said difference exceeds said prescribed temperature value.

9. An engine valve timing controller for controlling a hydraulically driven variable valve timing mechanism, comprising:

coolant temperature detecting means for detecting engine coolant temperature;

intake air temperature detecting means for detecting engine intake air temperature;

control means for controlling operation of the variable valve timing mechanism based on temperature signals from said coolant temperature detecting means and said intake air temperature detecting means, said control means preventing operation of the variable valve timing mechanism until the engine coolant temperature at least reaches a first operation permission coolant temperature that is higher than an operation assurance oil temperature of the variable valve timing mechanism when both the engine coolant temperature and the engine air intake temperature at time of engine startup are greater than or equal to the operation assurance oil temperature, said control means preventing operation of the variable valve timing mechanism until the engine coolant temperature at least reaches a second operation permission coolant temperature that is higher than said first operation permission coolant temperature when at least one of the engine coolant temperature and the engine intake temperature at time of engine startup is less than the operation assurance oil temperature.

10. The engine valve timing controller as recited in claim 9, wherein said control means is further preventing operation of the variable valve timing mechanism until the engine coolant temperature at least reaches said second operation permission coolant temperature, even if both the engine coolant temperature and the engine air intake temperature at time of engine startup are greater than or equal to the operation assurance oil temperature, when an absolute difference between the engine coolant temperature and the engine air intake temperature at time of engine startup exceeds a prescribed temperature value.

* * * * *